US007089597B2

(12) United States Patent
Horii et al.

(10) Patent No.: US 7,089,597 B2
(45) Date of Patent: Aug. 15, 2006

(54) CLOTHES FOR THE UPPER HALF OF BODY

(75) Inventors: Katsuko Horii, Kyoto (JP); Makoto Oyama, Kyoto (JP); Toshiko Murakami, Kyoto (JP)

(73) Assignee: Wacoal Corporation, Kyoto (JP)

( * ) Notice: Subject to any disclaimer, the term of this patent is extended or adjusted under 35 U.S.C. 154(b) by 119 days.

(21) Appl. No.: 10/432,060

(22) PCT Filed: Aug. 9, 2002

(86) PCT No.: PCT/JP02/08188

§ 371 (c)(1),
(2), (4) Date: May 14, 2003

(87) PCT Pub. No.: WO2004/014166

PCT Pub. Date: Feb. 19, 2004

(65) Prior Publication Data

US 2004/0133959 A1 Jul. 15, 2004

(51) Int. Cl.
*A41B 1/20* (2006.01)

(52) U.S. Cl. ..... 2/69; 2/106

(58) Field of Classification Search ..... 2/69, 2/44, 79, 115, 108, 105, 106, 2.11, 459, 461, 2/467, 16, 92, 125, 133, 134, 95, 85; 602/19, 602/60–63, 75; 482/124
See application file for complete search history.

(56) References Cited

U.S. PATENT DOCUMENTS 3,186,412 A 6/1965 Kurland
4,698,847 A * 10/1987 Yoshihara ..... 2/69
4,731,882 A * 3/1988 Ekman ..... 2/69
5,109,546 A * 5/1992 Dicker ..... 2/70
5,606,745 A * 3/1997 Gray ..... 2/69
5,708,976 A * 1/1998 Dicker ..... 2/69

FOREIGN PATENT DOCUMENTS

JP 61-124611 A1 6/1986
JP 61-239002 A1 10/1986
JP 62-117802 A1 5/1987
JP 3019336 A1 10/1995
JP 09-250008 A1 9/1997
JP 3046785 A1 12/1997
JP 10-292209 A1 11/1998

* cited by examiner

*Primary Examiner*—Gloria M. Hale
(74) *Attorney, Agent, or Firm*—Darby & Darby

(57) ABSTRACT

An upper body garment which selectively supports the muscles used during inhalation without hindering the movement of the spinal column. The upper body garment is constructed by stitching, to a shirt that adheres closely to the body, a plurality of band-form fabrics having a stretchability lower than that of the shirt. The stitching of the band-form fabrics occurs along several defined anatomical lines such as: the first lines that extend from the left and right acromia to a portion that corresponds to the center of the sternum, second lines which extend from this portion corresponding to the center of the sternum, pass beneath the breast area, and extend to the left and right armpit areas, and third lines which connect the left and right armpit areas of the second lines to each other on the back surface.

14 Claims, 7 Drawing Sheets

CLOTHES FOR THE UPPER HALF OF BODY

CROSS REFERENCE TO PRIOR APPLICATION

This is a U.S. national phase application under 35 U.S.C. §371 of International Patent Application No. PCT/JP02/08188, filed Aug. 9, 2002, and has not published as of the date of filing of the instant application.

TECHNICAL FIELD

The present invention relates to an upper body garment which has a main body part that adheres closely to at least the chest portion of the upper body. Such an upper body garment is not limited to men's garments or women's garments, but includes, for example, shirts (long sleeve shirts, half sleeve shirts, athletic shirts), body suits, swim wear, leotards and the like.

Furthermore, in the present specification, the term "low stretchability" means that the garment tends not to stretch in response to external forces, and shows a strong rebound force (contractile force) when stretched. Furthermore, the term "high stretchability" means that the garment readily stretches in response to external forces, and shows a weak rebound force (contractile force) when stretched.

BACKGROUND ART

In recent years, the physique of the Japanese population has improved, and the average body height has also increased. On the other hand, it has been reported that there is an increase in the number of persons with rounded backs and poor posture. It has been reported that such a deterioration in posture has occurred as a result of a drop in the muscular power of the back muscles and the like in the case of elderly persons, and as a result of a lack of knowledge of how to use the muscles (especially in the back) in the case of persons in younger age groups. Especially in the case of persons in younger age groups, it may be said that these persons do not sufficiently exhibit their own physical ability.

Many garments with structures that focus on posture and straighten the spinal column by pulling the shoulders to the rear have been proposed as means of solving the problem of such a deterioration in posture.

However, such garments suffer from the following problem: specifically, even though these garments straighten the spinal column, the garments fix the movement of the spinal column so that the degree of freedom of the operation of the muscles (especially in the back) is lowered, thus leading to the danger of a drop in muscular power.

Meanwhile, when a human being breathes deeply, the back muscles are stretched and the chest is expanded so that a good posture is formed. However, although conventional techniques relating to the support of the upper body or chest include techniques for supporting the muscles and skeleton of the back (Japanese Patent Application Laid-Open No. HEI 9-250008) and brassieres that have abreast shaping function (U.S. Pat. No. 309,602), the point of supporting the muscles used to breathe has not been proposed in any of these techniques.

The present invention was devised in order to solve the above mentioned problems; it is an object of the present invention to provide an upper body garment which can provide focused support of the muscles used during inhalation without hindering the movement of the spinal column.

DISCLOSURE OF THE INVENTION

As a result of long years of research conducted by the applicant of the present application, it was discovered that the curvature of the posterior arch 90 of the thoracic vertebrae decreases when a human being takes a deep breath, as may clearly be seen by comparing the ordinary state shown in FIG. 7A and the state during deep inhalation shown in FIG. 7B. Furthermore, FIG. 6 shows the movement of the sternum 80 during deep breathing by the position 80A prior to the taking of a deep breath and the position 80B following the taking of a deep breath. As is shown in this FIG. 6 as well, it was discovered that the muscles act so that sternum 80 is lifted in the forward and upward direction indicated by the arrows K1 and K2 (in the direction indicated by the arrow K3 in FIG. 7B). It has been ascertained that the principal muscles that act during such respiration are the external intercostal muscles, and that the latissimus dorsi muscles and greater pectoral muscles are used to assist these intercostal muscles.

In concrete terms, the external intercostal muscles are muscles that are positioned in the gaps between the ribs, and that connect the ribs to each other. During inhalation, as shown in FIG. 8A, these external intercostal muscles act to lift the ribs 92 as a whole in the direction indicated by the arrow L (i.e., to cause the sternum to move forward and upward).

Furthermore, the latissimus dorsi muscles 94 shown in FIG. 8B pull the chest wall toward the back center in the direction indicated by the arrow M during inhalation, and thus act to spread the chest wall to the outside and expand the chest. Moreover, the greater pectoral muscles 96 shown in FIG. 8C pull the chest wall toward the armpit areas in the direction indicated by the arrow N during inhalation, and thus act to widen the chest wall to the outside and expand the chest.

On the basis of these actions, in order to achieve the abovementioned object, the upper body garment of the present invention is an upper body garment which has a main body part that adheres closely to at least the chest portion of the upper body, this garment being characterized in that band-form fabrics which have lower stretchability than the main body part are stitched to the main body part along first lines which extend from the left and right acromia to a part corresponding to the center of the sternum, second lines which extend from this part corresponding to the sternum, pass beneath the breast area and extend to the areas of the left and right armpits, and a third line which connects the areas of the left and right armpits in the second lines on the back surface.

In the present invention, the band-form fabrics with lower stretchability that are stitched along the first lines extending from the left and right acromia to the part corresponding to the center of the sternum and the second lines extending from the part corresponding to the center of the sternum, passing beneath the breast area and extending to the areas of the left and right armpits are positioned in directions that are oriented along the muscle fibers of the external intercostal muscles that act to lift the chest wall forward and upward when the garment is worn.

Furthermore, the band-form fabric with low stretchability which is stitched along the third line that connects the areas of the left and right armpits in the second lines on the back surface is positioned in a direction that is oriented along the muscle fibers of the latissimus dorsi muscles that face toward the center of the back from the armpit areas (in concrete terms, the muscles that face the vicinity of the seventh and eighth thoracic vertebrae) when the garment is worn.

Since the stretchability of the band-form fabrics is lower than those of the main body part, an appropriate degree of pressure is applied along the first through third lines, i.e., along the respective muscle fibers of the external intercostal muscles and latissimus dorsi muscles, when the upper body garment of the present invention is worn, so that the muscular contractile movement of the external intercostal muscles and latissimus dorsi muscles as muscles that are used during inhalation can be supported. In this case, since the muscles are naturally supported along the muscle fibers, there is no hindrance of muscular movement and the like by the application of an excessive force to the body as there is in the case of conventional corrective garments or the like that forcibly pull the shoulders to the rear.

Thus, if the upper body garment of the present invention is worn, a force that expands the chest acts naturally, so that the muscles used during inhalation can be supported selectively without hindering the movement of the spinal column.

Furthermore, the third line connects the areas of the left and right armpits in the second lines on the back surface; in this case, the third line may have a construction that is connected with the second lines, or may have a construction that is not directly connected, but is rather connected slightly above or slightly below the left and right armpit areas of the second line.

Furthermore, the fabric oriented along the third line and the fabrics oriented along the second lines may have the same width, or may have different widths. For example, a construction may be used in which the fabric oriented along the third line and the fabrics oriented along the second lines are connected at a width of approximately 1 cm, while portions of other widths are not connected. Furthermore, in cases where portions of different widths are used as described above, an effect in which a force that pulls the chest wall toward the center of the back can easily be applied can be obtained if the garment is constructed so that the width of the fabric that is oriented along the third line positioned on the side of the back is wider than the width of the fabrics oriented along the second lines.

The upper body garment of the present invention may also be described as "an upper body garment comprising a main body part, and band-form fabrics with stretchability lower than those of the main body part, which are stitched to the main body part along first lines that extend from the left and right upper end portions of the front side of the main body part to the central portion of the front side, second lines that extend from the central portion of the front side to the left and right armpit areas on the front side, and a third line that connects the left and right armpit areas of the second lines on the back side of the main body part".

In the upper body garment of the present invention, the garment may be constructed so that the third line connects the left and right armpit portions of the second lines to each other on the side of the back surface of the main body part. In this case, a construction in which the fabric oriented along the third line and the fabrics oriented along the second lines are directly connected or a construction in which these fabrics are continuous is used; accordingly, a pressure can be more easily applied along the respective muscle fibers of the external intercostal muscles and the latissimus dorsi muscles, so that the advantage of more effective support of the muscular contractile movements of the external intercostal muscles and latissimus dorsi muscles is obtained.

Furthermore, in the upper body garment of the present invention, if a construction is used in which the direction of stretch of the fabrics is oriented along the longitudinal direction of these fabrics, then the direction of contraction of the muscles that are contacted and the direction of stretch of the fabrics will more or less coincide, so that the fabrics will expand and contract in accordance with the movement of the muscles of the wearer while maintaining low stretchability. Accordingly, the movement of the muscles can be supported so that a natural feeling of wearing can be realized without imparting any feeling of constriction or feeling of restraint to the wearer.

Furthermore, in the upper body garment of the present invention, it is desirable to construct the fabrics that are stitched along the first lines and the fabrics that are stitched along the second lines from the same strip of fabric. In this case, a construction is used in which the fabric that extends from the top of the left shoulder to the right armpit area through the portion that corresponds to the center of the sternum and the fabric that extends from the top of the right shoulder to the left armpit area through the portion that corresponds to the center of the sternum intersect in the portion that corresponds to the center of the sternum; however, since the overall lines that extend from the acromia to the armpit areas are supported by the same strip of fabric, the required stretchability can easily be applied, so that the external intercostal muscles can be more effectively supported along the muscle fibers.

Furthermore, in the upper body garment of the present invention, it is desirable to use a construction in which band-form fabrics are stitched to the main body part along fourth lines which extend from the portion corresponding to the center of the sternum, pass above the breast area, and extend to the armpit areas. In this case, the band-form fabrics with low stretchability that are stitched along these fourth lines are positioned in directions oriented along the muscle fibers of the greater pectoral muscles that face the armpit areas from the portion corresponding to the center of the sternum when the garment is worn; accordingly, an appropriate pressure is applied along these fourth lines, i.e., along the muscle fibers of the greater pectoral muscles, so that the greater pectoral muscles can be further supported as muscles used during inhalation. As a result, the effect of supporting muscles used during inhalation is increased.

Furthermore, in the upper body garment of the present invention, it is desirable to use a construction in which band-form fabrics are stitched to the main body part along fifth lines extending from specified positions on the first lines located on the upper portion of the breast to the armpit areas. In this case, such band-form fabrics with low stretchability that are stitched along the fifth lines are positioned in directions that are oriented along the muscle fibers of the greater pectoral muscles facing toward the armpit areas from the portion corresponding to the center of the sternum. Accordingly, an appropriate degree of pressure is applied along these fifth lines, i.e., along the muscle fibers of the greater pectoral muscles, so that the greater pectoral muscles can be further supported as muscles used during inhalation. As a result, the effect of supporting muscles used during inhalation is increased.

Furthermore, it is desirable to use a construction in which band-form fabrics are stitched to the main body part along a sixth line which connects the left and right armpit areas of the fifth lines on the back surface. In this case, in the same manner as that described above, the band-form fabric with low stretchability that is stitched along the sixth line is positioned in a direction that is oriented along the muscle fibers of the latissimus dorsi muscles facing toward the center of the back from the armpit areas (specifically, in the vicinity of or slightly above the seventh and eighth thoracic vertebrae) when the garment is worn. Accordingly, an appropriate pressure is applied along this sixth line, i.e., along the muscle fibers of the latissimus dorsi muscles, so that the effect of supporting the latissimus dorsi muscles as muscles used during inhalation is increased.

Furthermore, the sixth line connects the left and right armpit areas of the fifth lines on the back surface; in this case, a construction in which the sixth line is connected with the fifth lines may be used, or a construction in which these lines are not directly connected, but are rather connected slightly above or slightly below the left and right armpit areas of the fifth lines, may be used.

Furthermore, the fabric that is oriented along the sixth line and the fabrics that are oriented along the fifth lines may have the same width, or may have different widths. For example, a construction may be used in which the fabric oriented along the sixth line and the fabrics oriented along the fifth lines are connected at a width of approximately 1 cm, while portions of other widths are not connected. Furthermore, in cases where portions of different widths are used as described above, an effect in which a force that pulls the chest wall toward the center of the back can easily be applied can be obtained if the garment is constructed so that the width of the fabric that is oriented along the sixth line positioned on the side of the back is wider than the width of the fabrics oriented along the fifth lines.

Of course, a construction may also be used in which the sixth line connects the left and right armpit areas of the fifth lines to each other on the back surface. In this case, a construction is used in which the fabric that is oriented along the sixth line and the fabrics that are oriented along the fifth lines are directly connected, or a construction in which these fabrics are continuous, is used. Accordingly, pressure can easily be applied along the respective muscle fibers of the greater pectoral muscles and latissimus dorsi muscles, so that the advantage of more effective support of the muscular contractile movements of the greater pectoral muscles and latissimus dorsi muscles is obtained.

In the upper body garment of the present invention, it is desirable to use a construction in which band-form fabrics are stitched to the main body part along seventh lines which are continuous with the first lines at the left and right acromia, and which connect the tops of these shoulders with either specified positions on the third lines or specified positions on the sixth line, or both. In this case, the seventh lines are continuous with the first lines at the left and right acromia, and either connect both specified positions on the third lines and specified positions on the sixth lines with the acromia, or connect either specified positions on the third lines or specified positions on the sixth lines with the acromia.

Such band-form fabrics with low stretchability that are stitched along the seventh lines perform an action which maintains a force that pulls the shoulders to the rear and lifts the shoulders along the first lines on the side of the back. Accordingly, the effect that supports the external intercostal muscles along the muscle fibers and expands the chest can be reinforced.

Furthermore, it is desirable to use a construction in which band-form fabrics are stitched to the main body part along eighth lines which are continuous with a first lines at the left and right acromia, and which connect the acromia with specified positions on the third lines. In this case, in the same manner as described above, the band-form fabrics with low stretchability that are stitched along the eighth lines perform an action which maintains a force that pulls the shoulders to the rear and lifts the shoulders along the first lines on the side of the back. Accordingly, the effect that support the external intercostal muscles along the muscle fibers and expands the chest can be reinforced.

In the upper body garment of the present invention, it is desirable to use a construction in which a padding material with stretchability that are lower than those of the fabrics is applied to the left and right armpit areas so that the longitudinal direction of this padding material is oriented in the vertical direction of the armpit areas. In this case, as a result of this padding material being applied to the left and right armpit areas in the vertical direction, the abovementioned padding material acts as a supporting point in cases where a force acts on the left and right armpit areas along the second lines, third lines and the like; accordingly, support of the external intercostal muscles along the second lines and support of the latissimus dorsi muscles along the third lines can be more effectively achieved.

Furthermore, it is desirable that a construction be used in which the main body part is constructed by stitching together a front body part and a rear body part in the left and right armpit areas, and in which the stretchability of the left and right armpit areas is set to be lower than that of the fabrics. In this case, there is almost no stretch of the material in the locations where the front body part and rear body part are stitched together in the left and right armpit areas. Accordingly, in the same manner as described above, the stitching locations act as supporting points in cases where a force is applied to the armpit areas along the second lines, third lines and the like. Consequently, the support of the external intercostal muscles along the second lines and the support of the latissimus dorsi muscles along the third lines can be more effectively achieved.

The abovementioned object and other special features and advantages of the present invention will be evident to a person skilled in the art upon reading the following detailed description with reference to the attached figures.

BEST MODES FOR CARRYING OUT THE INVENTION

Embodiments of the upper body garment of the present invention will be described below with reference to the attached figures. Furthermore, the same symbols are assigned to the same elements, and a redundant description is omitted.

Figure 1A:
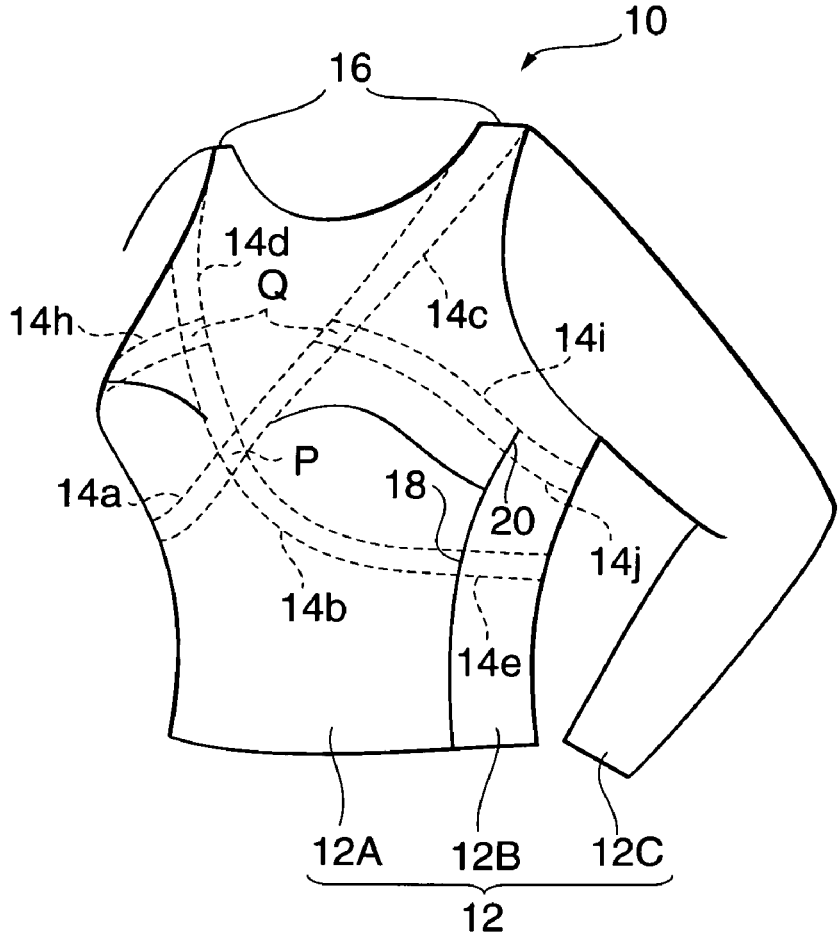
FIG. 1A is a perspective view showing a projection of the front surface of an upper body garment constituting an embodiment of the present invention.
Figure 1B:
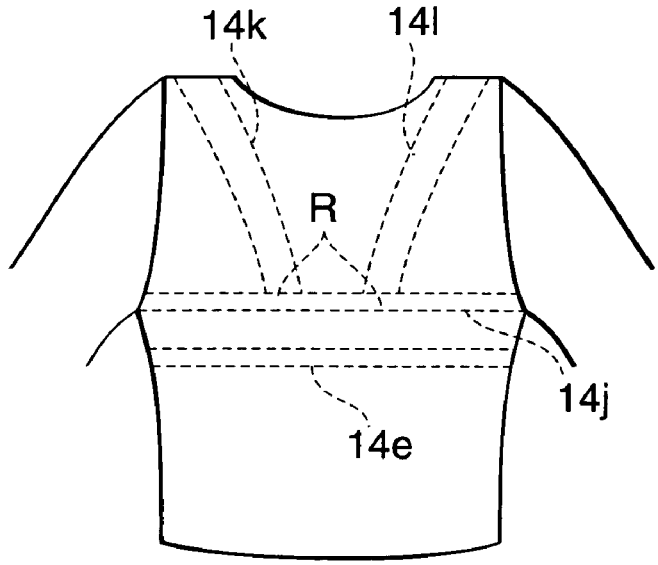
FIG. 1B is a back view of this upper body garment constituting an embodiment of the present invention.

FIG. 1A is a perspective view showing one example of the construction of an upper body garment constituting the present embodiment, and FIG. 1B is a back view of the same. As is shown in these FIGS. 1A and 1B, the upper body garment 10 is constructed so that this garment comprises a long-sleeve round-neck shirt 12 which adheres closely to the body, and a plurality of band-form fabrics 14*a*, 14*b* . . . that are stitched to this shirt 12 in the specified positions described below. Furthermore, The plurality of band-form fabrics 14*a*, 14*b* . . . are collectively referred to as "fabrics 14".

The shirt 12 is constructed by stitching together a front body part 12A, a rear body part 12B, and sleeve parts 12C. In the armpit areas 18 and 20 (which are the locations where the front body part 12A and rear body part 12B are stitched together) and shoulder tops 16, there is almost no stretch of the material; accordingly, these parts function effectively as supporting points in the action of the forces described below.

The respective fabrics 14 consist of tricot, power net or the like, and are constructed so that the stretchability of these fabrics is lower than the stretchability of the shirt 12. Furthermore, a construction is used in which the direction of stretch of the respective fabrics 14 is the longitudinal direction of these fabrics.

The fabrics 14 are constructed from fabrics 14*c* and 14*d* which are stitched along first lines that extend from the left and right shoulder tops 16 to a portion P corresponding to the center of the sternum, fabrics 14*a* and 14*b* which are stitched along second lines that extends from the portion P corresponding to the center of the sternum, pass beneath the breast portion, and extend to the left and right armpit areas 18, a fabric 14*e* which is stitched along a third line that connects the armpit areas 18 of the second lines to each other on the back surface, fabrics 14*h* and 14*i* which are stitched along fifth lines that extend from specified positions Q above the breast portion on the first lines 1 to the armpit areas 20, a fabric 14*j* which is stitched along a sixth line that connects the left and right armpit areas 20 of the fifth lines to each other on the back surface, and fabrics 14*k* and 14*l* which are stitched along seventh lines that are continuous with the first lines at the shoulder tops 16, and that connect these shoulder tops 16 with specified positions R on the sixth line.

Among these fabrics, the fabrics 14*a*, 14*c*, 14*b* and 14*d* that are stitched along the first lines and second lines are positioned in directions along the muscle fibers of the external intercostal muscles that have the action of lifting the chest wall in the forward and upward direction. Accordingly, an appropriate pressure is applied along the first and second lines, i.e., along the muscle fibers of the external intercostal muscles, so that the external intercostal muscles can be supported as muscles that are used during inhalation. Furthermore, the fabric 14*a* and fabric 14*c* are not stitched at the point P, but are rather construction from the same strip of fabric. Similarly, the fabric 14*b* and fabric 14*d* are also constructed from the same strip of fabric. Accordingly, this construction is advantageous in that the external intercostal muscles can be more effectively supported along the muscle fibers.

Furthermore, the fabric 14*e* that is stitched along the third line is positioned in a direction that is oriented along the muscle fibers of the latissimus dorsi muscles that have the action of expanding the chest by pulling the armpit areas toward the back center so that the chest wall is spread outward during inhalation. Accordingly, an appropriate degree of pressure is applied along the third line, i.e., along the muscle fibers of the latissimus dorsi muscles, so that the latissimus dorsi muscles can be supported as muscles that are used during inhalation.

Furthermore, the fabrics 14*h* and 14*i* that are stitched along the fifth lines are positioned in directions oriented along the muscle fibers of the greater pectoral muscles that have the action of expanding the chest by pulling the chest wall toward the armpit areas so that the chest wall is spread outward during inhalation. Accordingly, an appropriate degree of pressure is applied along the fifth lines, i.e., along the muscle fibers of the greater pectoral muscles, so that the greater pectoral muscles can be supported as muscles that are used during inhalation.

Furthermore, the fabric 14*j* that is stitched along the sixth line is positioned in a direction that is oriented along the muscle fibers of the latissimus dorsi muscles that face toward the rear center from the armpit areas (in concrete terms, in the vicinity of or slightly above the seventh and eighth thoracic vertebrae). Accordingly, an appropriate degree of pressure is applied along the sixth line, i.e., along the muscle fibers of the latissimus dorsi muscles, so that the latissimus dorsi muscles can be supported as muscles that are used during inhalation.

Furthermore, the fabrics 14*k* and 14*l* that are stitched along the seventh lines have the action of maintaining the force that pulls the shoulders to the rear and lifts the chest wall along the first lines on the side of the back. Accordingly, the external intercostal muscles can be supported along the muscle fibers, so that the effect that expands the chest can be reinforced.

Thus, the muscles that are used in inhalation (external intercostal muscles, latissimus dorsi muscles and greater pectoral muscles) can be supported along the respective lines. In this case, since the muscles are naturally supported along the muscle fibers, the garment of the present invention differs from conventional corrective garments, and the like that forcibly pull the shoulders to the rear in that hindrance of the movement of the spinal column can be avoided even if the spinal column is straightened.

Thus, if the upper body garment 10 is worn, a force that expands the chest acts naturally, so that the muscles that are used in inhalation can be supported in a focused manner.

Furthermore, since the garment is constructed so that the direction of stretch of the respective fabrics 14 is the longitudinal direction of the fabrics 14, the fabrics 14 can expand and contract slightly in accordance with the movements of the body of the wearer even though low stretchability is maintained. Accordingly, a natural feeling of wear can be realized without imparting a feeling of constriction or feeling of restraint to the wearer.

Furthermore, in FIG. 1B, a construction was shown in which the fabrics 14*k* and 14*l* connected the shoulder tops 16 with specified positions R on the fabric 14*j*. However, it would also be possible to use a construction in which the fabrics 14*k* and 14*l* connect the shoulder tops 16 with specified intermediate positions on the fabric 14*e*. In this case as well, the fabrics 14*k* and 14*l* perform an action which maintains the force that pulls the shoulders to the rear and lifts along the first lines on the side of the back when the garment is worn; accordingly, the effect of the present embodiment in expanding the chest can be reinforced by supporting the external intercostal muscles along the muscle fibers.

Figure 5:
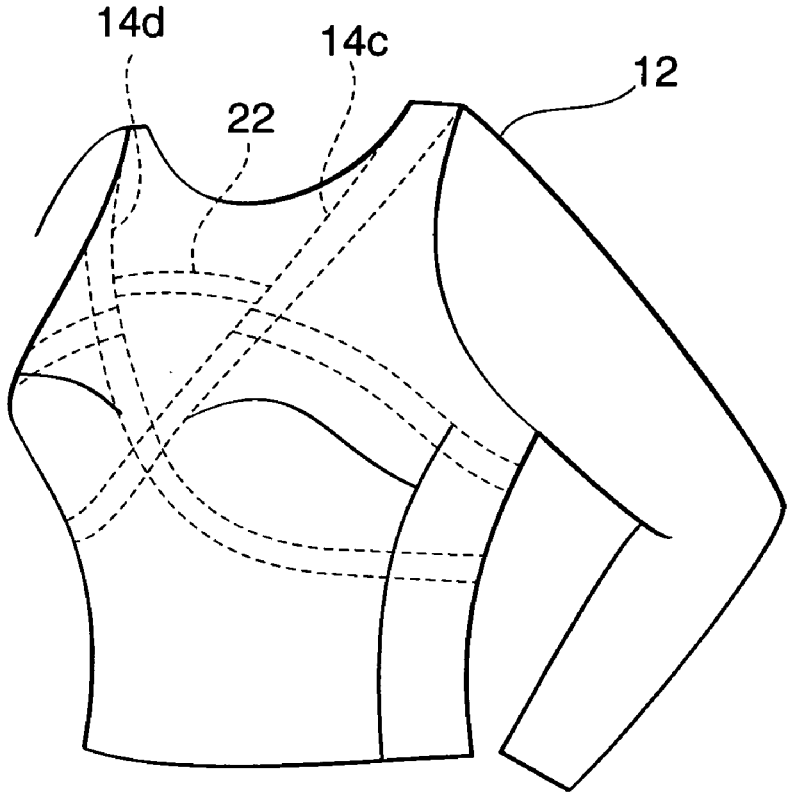
FIG. 5 is a structural diagram in which a fabric used to prevent collapse during wear is further disposed on the upper body garment shown in FIG. 1A.
Figure 6:
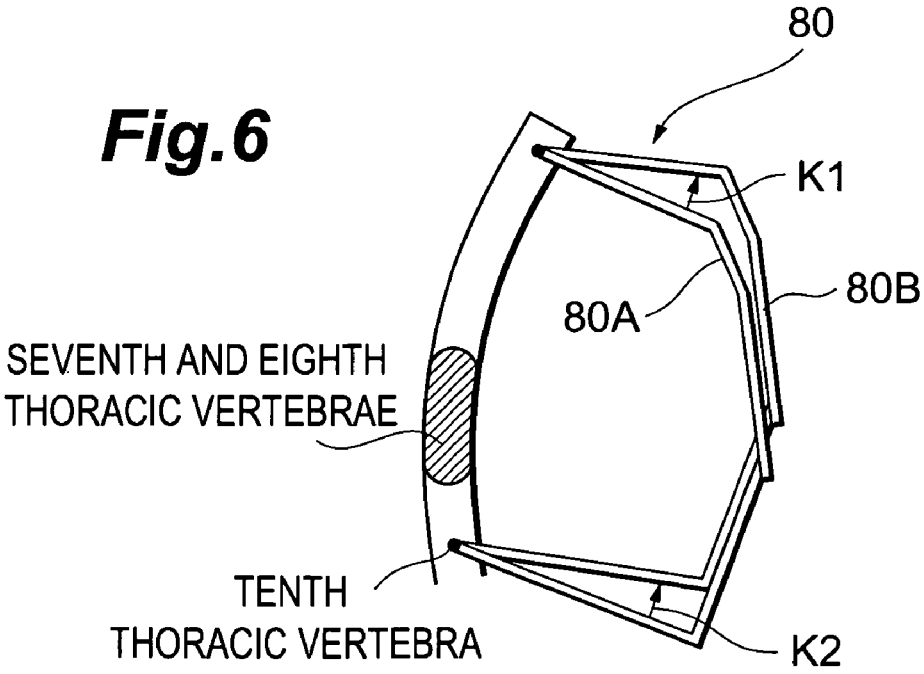
FIG. 6 is a diagram which shows the movement of the sternum during deep breathing.
Figure 7A:
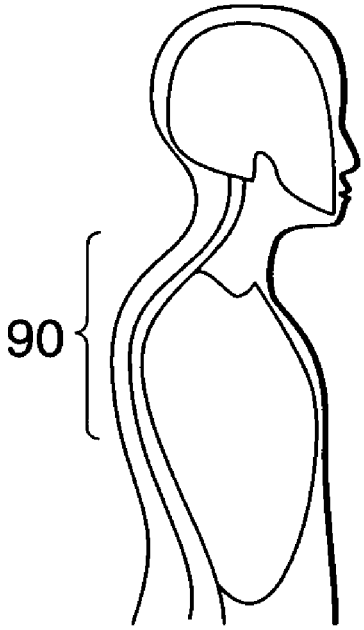
FIG. 7A is a diagram which shows the ordinary state of the posterior arch of the thoracic vertebrae.
Figure 7B:
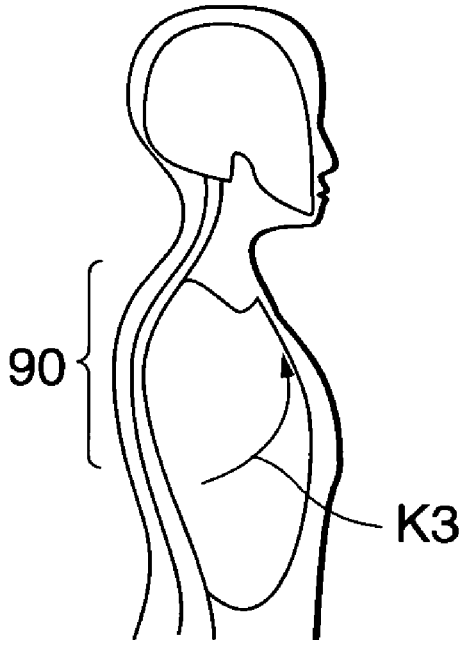
FIG. 7B is a diagram which shows the state of the posterior arch of the thoracic vertebrae during inhalation.
Figure 8C:
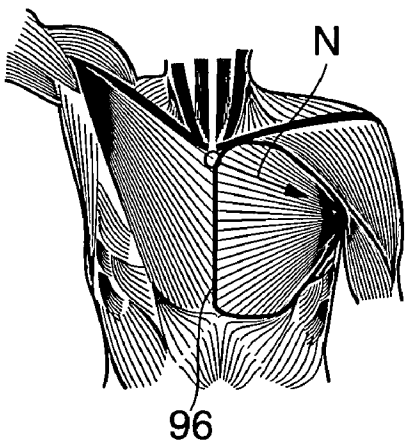
FIG. 8C is a diagram which is used to illustrate the action of the greater pectoral muscles during inhalation.
Figure 8B:
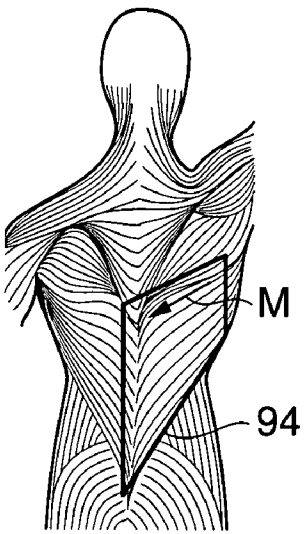
FIG. 8B is a diagram which is used to illustrate the action of the latissimus dorsi muscles during inhalation.
Figure 8A:
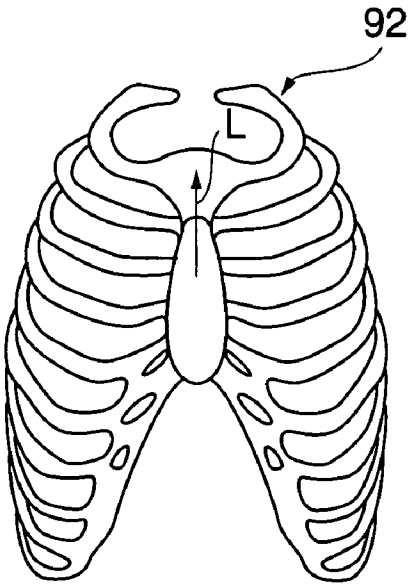
FIG. 8A is a diagram which is used to illustrate the action of the external intercostal muscles during inhalation.

Furthermore, in the construction shown in FIG. 1A, it would also be possible to add a fabric 22 which connects the fabrics 14*c* and 14*d* above the breast area as shown in FIG. 5 so that the fabrics 14*c* and 14*d* are not excessively separated from each other, and which thus prevents the fabric 14*c* and fabric 14*d* from opening too widely to the left and right, thus causing a shift in the places of contact so that no force is applied to the required locations. However, in order to avoid a pressing feeling on the chest, it is desirable that this fabric 22 be constructed from a material which has stretchability that is lower than that of the shirt 12 but higher than that of the fabrics 14*c* and 14*d*, so that there is no excessive pressure on the places of contact.

Figure 2A:
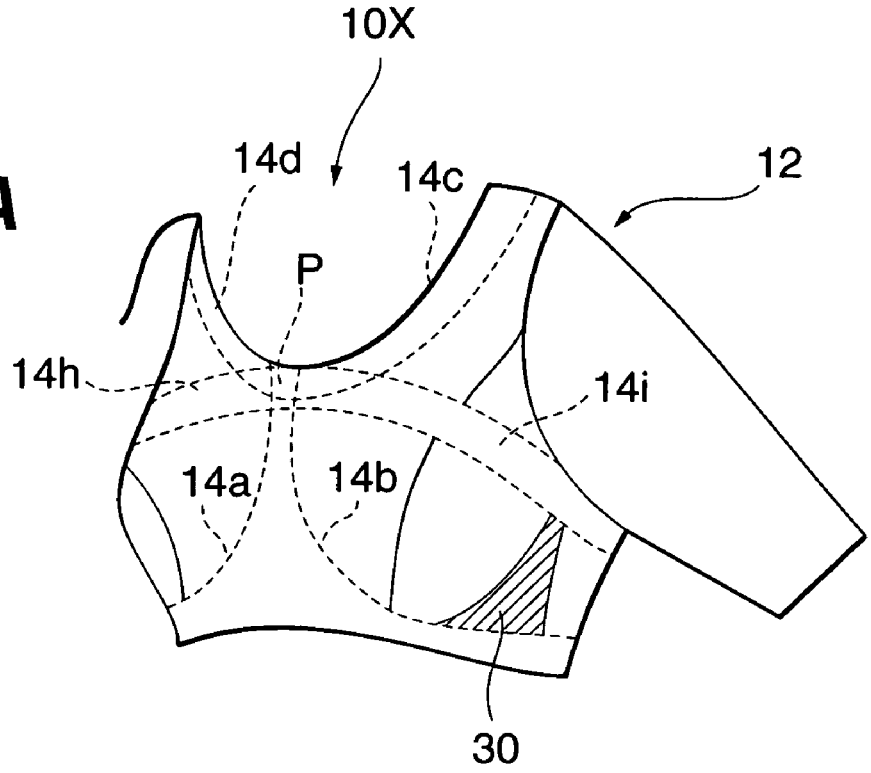
FIG. 2A is a perspective view showing a projection of the front surface of an upper body garment constituting another embodiment of the present invention.
Figure 2B:
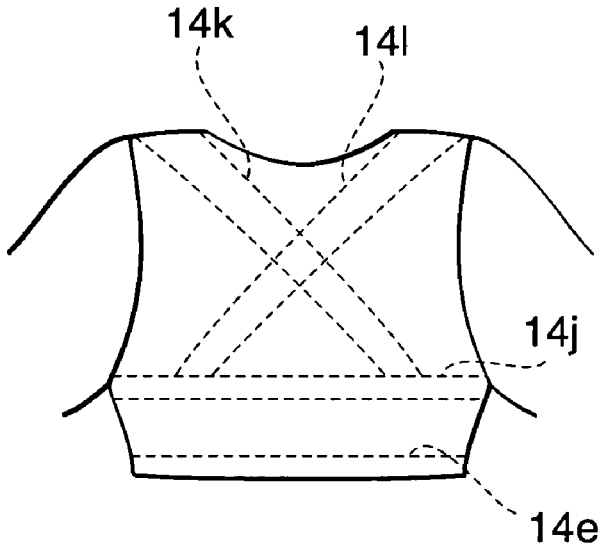
FIG. 2B is a back view of this upper body garment constituting another embodiment of the present invention.

Other embodiments of the present invention will be described below with reference to FIGS. 2A through 4B. The upper body garment 10X shown in FIGS. 2A and 2B, is constructed from a half-sleeve U-neck shirt 12 with a short length, and a plurality of band-form fabrics 14 which are stitched to this shirt 12 in more or less the same specified positions as in FIGS. 1A and 1B.

However, in this upper body garment 10X, fabrics 14*c* and 14*d* are stitched around the U-neck, and wide fabrics 14*a* and 14*b* are stitched along lines that extend from a supporting point P at the front center to the armpits, passing beneath the breast area. Among these fabrics, the left and right upper edge portions of the fabrics 14*a* and 14*b* are positioned in directions that are oriented along the muscle fibers of the external intercostal muscles; accordingly, these fabrics 14*a* and 14*b* and the fabrics 14*c* and 14*d* that are connected with these fabrics 14*a* and 14*b* at the supporting point P form an integrated body, so that the external intercostal muscles can be supported.

Furthermore, fabrics 14*h* and 14*i* are stitched along fourth lines which extend from the supporting point P to the armpits, passing above the breast area. These fabrics 14*h* and 14*i* are positioned in directions that are oriented along the muscle fibers of the greater pectoral muscles that face toward the armpit areas from the supporting point P; accordingly, an appropriate degree of pressure is applied along the muscle fibers of the greater pectoral muscles, so that the greater pectoral muscles can be supported.

Furthermore, a compressed polyurethane sheet 30 which shows almost no stretch is applied to the left and right armpit areas in the vertical direction as a padding material whose stretchability is even lower than that of the fabrics 14. This compressed polyurethane sheet 30 acts as a supporting point in cases where the force of the fabrics 14 acts on the armpit areas; accordingly, support of the external intercostal muscles along the second lines, support of the latissimus dorsi muscles along the third line, and support of the greater pectoral muscles along the fourth lines, can be achieved more effectively. Furthermore, besides a compressed polyurethane sheet 30, a material such as a resin bone, a resin sheet, a double raschel that shows almost no stretch, a compressed nonwoven fabric or the like may be used as the abovementioned padding material.

Furthermore, as is shown in FIG. 2B, a construction is used in which the fabrics 14*k* and 14*l* cross each other in the center of the back. In regard to the fabrics 14*k* and 14*l*, either a construction in which these fabrics do not cross each other as shown in FIG. 1B, or a construction in which these fabrics cross each other as shown in FIG. 2B, may be used. In either case, an action which maintains the force that pulls the shoulders to the rear and lifts along the first lines on the side of the back is performed; accordingly, the effect of the present embodiment that supports the external intercostal muscles along the muscle fibers and expands the chest can be reinforced.

Furthermore, the present invention can also exhibit actions and effects similar to those described above by means of an embodiment such as that shown in below in FIG. 3A or 3B, or an embodiment such as that shown below in FIGS. 4A and 4B.

Figure 3B:
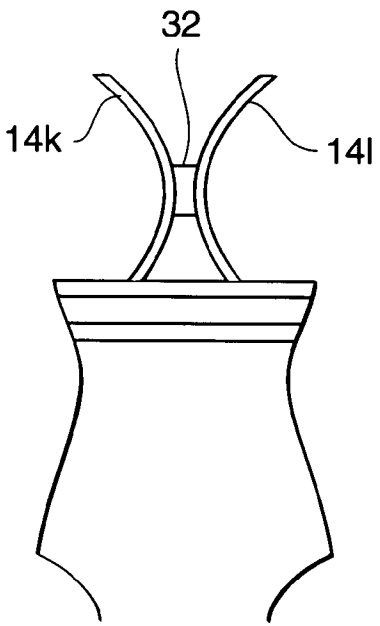
FIG. 3B is a back view of this upper body garment constituting another embodiment of the present invention.
Figure 3A:
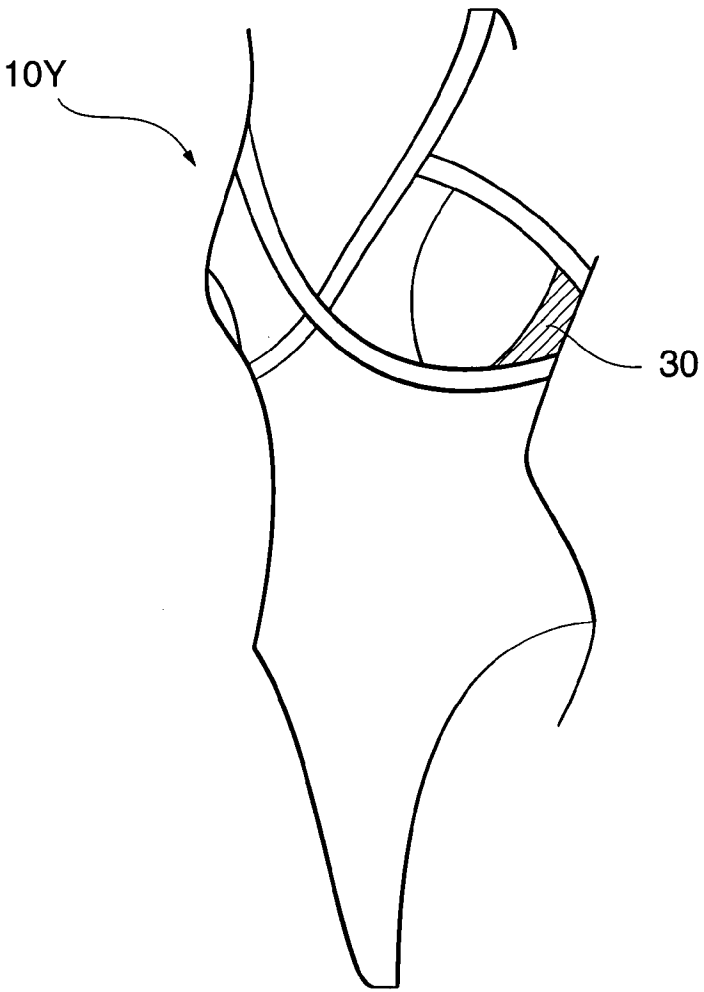
FIG. 3A is a perspective view showing a projection of the front surface of an upper body garment constituting another embodiment of the present invention.

For example, the upper body garment 10Y shown in FIGS. 3A and 3B is an example of a construction in which the present invention is applied to women's swim wear. The disposition of the fabrics 14 is more or less similar to that in the example shown in FIGS. 1A and 1B; in this construction, however, a compressed polyurethane sheet 30 is applied to the left and right armpit areas as a padding material whose stretchability is even lower than that of the fabrics 14, and the fabrics 14*k* and 14*l* on the back are connected by a fabric 32 in the central portion of the back.

Figure 4A:
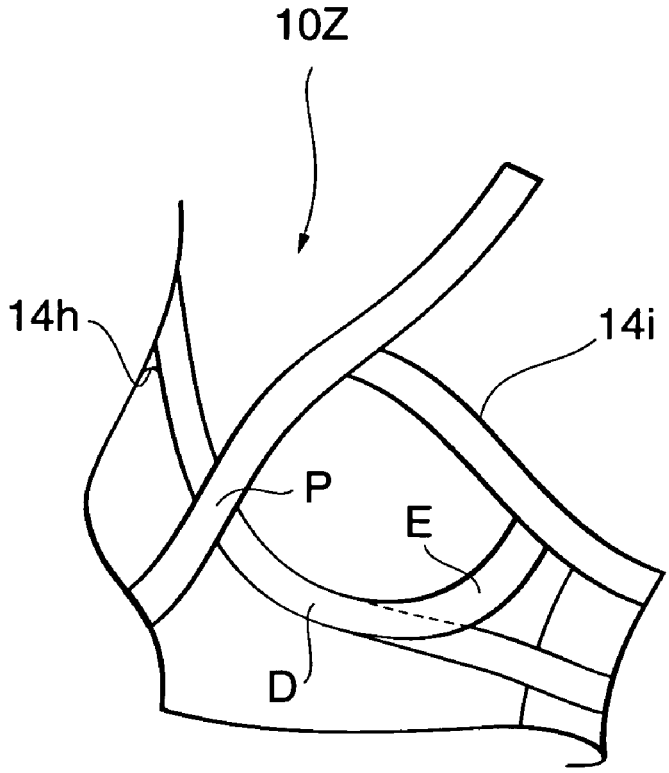
FIG. 4A is a perspective view showing a projection of the front surface of an upper body garment constituting another embodiment of the present invention.
Figure 4B:
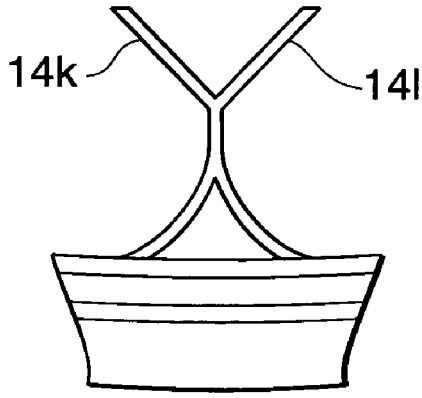
FIG. 4B is a back view of this upper body garment constituting another embodiment of the present invention.

Furthermore, the upper body garment 10Z shown in FIGS. 4A and 4B is an example of a construction in which the present invention is applied to a mini-top. Here, the disposition of the fabrics 14 is more or less the same as in the example shown in FIGS. 1A and 1B; however, fabrics 14 are respectively stitched to lines D (corresponding to the abovementioned second lines) which extend to the armpits from the supporting point P after passing beneath the breast area, and lines E which branch from lines D beneath the breast area and reach the fabrics 14*h* and 14*i* along the armpit sides of verge's lines. Furthermore, in this construction, the fabrics 14*k* and 14*l* on the back are connected in the central portion of the back.

Thus, the present invention is not limited to men's garments or women's garments, but may be applied to various types of upper body garments that adhere closely to the body (for example, shirts (long-sleeve, half-sleeve and athletic shirts), body suits, swim wear, leotards and the like).

INDUSTRIAL APPLICABILITY

In the upper body garment of the present invention, as was described above, an appropriate pressure is applied to the first through third lines, i.e., along the muscle fibers of muscles used in inhalation, when the garment is worn; accordingly, a force which expands the chest acts naturally, so that the muscles that are used in inhalation can be supported selectively.

The invention claimed is:

1. An upper bady garment worn by a user having an upper body and a chest portion, comprising:

a main body part comprising an approximately non-stretchable material which adheres closely to at least the chest portion of the upper body, having portions corresponding to a left acromia, a right acromia, a center of a sternum, a breast portion, a left armpit area, a right armpit area, and a back surface of the user; and band-form fabrics with stretchability that is lower than that of said main body part are stitched to said main body part along:

first lines which extend from the left and right acromia to a portion corresponding to the center of the sternum;

second lines which extend from said portion corresponding to the center of the sternum, pass beneath the breast portion and extend to the left and right armpit areas; and a third line which connects the left and right armpit areas of said second lines on the back surface;

wherein the band-form fabrics stitched along the first and second lines, are positioned in directions that are oriented along muscle fibers of external intercostal muscles that act to lift a chest wall forward and upward when the garment is worn; and the band-form fabric stitched along the third line is positioned in a direction that is oriented along muscle fibers of latissimus dorsi muscles that face toward a back center from the left and right armpit areas when the garment is worn.

2. An upper body garment comprising:

a main body part comprising an approximately non-stretchable material and having front side with a central portion, a back side, a left armpit area, a right armpit area, a left upper end portion, and a right upper end portion; and band-form fabrics with stretchability lower than that of said main body part, which are stitched to said main body part along first lines that extend from the left and right upper end portions of the front side of said main body part to the central portion of said front side, second lines that extend from said central portion of the front side to the left and right armpit areas on said front side, and a third line that connects the left and right armpit areas of the second lines on the back side of said main body part;

wherein the band-form fabrics that are stitched along the first lines and the second lines, are positioned in directions that are oriented along muscle fibers of external intercostal muscles that act to lift a chest wall forward and upward when the garment is worn; and the band-form fabric which is stitched along the third line is positioned in a direction that is oriented along muscle fibers of latissimus dorsi muscles that face toward a back center from the left and right armpit areas when the garment is worn.

3. The upper body garment according to claim 2 wherein said third line connects the left and right armpit areas of said second lines to each other on the back side of said main body part.

4. The upper body garment according to claim 2 wherein the direction of stretch of said fabrics is the longitudinal direction of said fabrics.

5. The upper body garment according to claim 2 wherein the fabrics that are stitched along said first lines and the fabrics that are stitched along said second lines are constructed from the same strip of fabric.

6. The upper body garment according to claim 1 wherein said band-form fabrics are stitched to said main body part along fourth lines which extend from said portion corresponding to the center of the sternum, pass above the breast portion, and extend to said armpit areas.

7. The upper body garment according to claim 1 wherein said band-form fabrics are stitched to said main body part along fifth lines which extend from specified positions on said first lines located above the breast portion to said armpit areas.

8. The upper body garment according to claim 7 wherein said band-form fabric is stitched to said main body part along a sixth line which connects the left and right armpit areas of said fifth lines on the back surface.

9. The upper body garment according to claim 8 wherein said sixth line connects the left and right armpit areas of said fifth lines to each other on the back surface.

10. The upper body garment according to claim 8 wherein said band-form fabrics are stitched to said main body part along seventh lines which are continuous with said first lines at the left and right acromia, and which connect said acromia with at least either specified positions on said third lines or specified positions on said sixth lines.

11. The upper body garment according to claim 1 wherein said band-form fabrics are stitched to said main body part along eighth lines which are continuous with said first lines at the left and right acromia, and which connect said acromia with specified positions on said third lines.

12. The upper body garment according to claim 2 wherein a padding material with stretchability lower than that of said fabrics is applied to said left and right armpit areas so that the longitudinal direction of said padding material is oriented along the vertical direction of said armpit areas.

13. The upper body garment according to claim 2 wherein said main body part has a construction in which a front body part and a rear body part are stitched together in said left and right armpit areas, and the stretchability of said armpit areas is set to be lower than that of said fabrics.

14. An upper body garment worn by a user having an upper body and a chest portion, comprising:

a main body part comprising an approximately non-stretchable material which adheres closely to at least the chest portion of the upper body, having portions corresponding to a left acromia, a right acromia, a center of a sternum, a breast portion, a left armpit area, a right armpit area, and a back surface of the user; and band-form fabrics with stretchability in a longitudinal direction of the band-formed fabrics and that is lower than that of said main body part are stitched to said main body part along:

first lines which extend from the left and right acromia to a portion corresponding to the center of the sternum;

second lines which extend from said portion corresponding to the center of the sternum, pass beneath the breast portion and extend to the left and right armpit areas; and a third line which connects the left and right armpit areas of said second lines on the back surface;

wherein the band-form fabrics stitched along the first and second lines, are positioned in directions that are oriented along muscle fibers of external intercostal muscles that act to lift a chest wall forward and upward when the garment is worn; and the band-form fabric stitched along the third line is positioned in a direction that is oriented along muscle fibers of latissimus dorsi muscles that face toward a back center from the left and right armpit areas when the garment is worn.

* * * * *

UNITED STATES PATENT AND TRADEMARK OFFICE

CERTIFICATE OF CORRECTION

PATENT NO. : 7,089,597 B2
APPLICATION NO. : 10/432060
DATED : August 15, 2006
INVENTOR(S) : Katsuko Horii et al.

It is certified that error appears in the above-identified patent and that said Letters Patent is hereby corrected as shown below:

On The Title Page, Item (54)
In the Title:

Please delete "CLOTHES FOR THE UPPER HALF OF BODY" and substitute

-- UPPER BODY GARMENT --.

Signed and Sealed this

Eighteenth Day of September, 2007

JON W. DUDAS
*Director of the United States Patent and Trademark Office*